US007249792B1

(12) United States Patent
Bunten

(10) Patent No.: US 7,249,792 B1
(45) Date of Patent: Jul. 31, 2007

(54) LAWN DEBRIS CARRIER

(76) Inventor: Steven A. Bunten, 221 Oak Ter., Atwood, IL (US) 61913

( * ) Notice: Subject to any disclaimer, the term of this patent is extended or adjusted under 35 U.S.C. 154(b) by 147 days.

(21) Appl. No.: 11/215,480

(22) Filed: Aug. 30, 2005

Related U.S. Application Data

(60) Provisional application No. 60/605,641, filed on Aug. 30, 2004.

(51) Int. Cl.
*B65F 5/00* (2006.01)

(52) U.S. Cl. ..... 294/1.1; 294/152

(58) Field of Classification Search ..... 294/1.1, 294/152, 156; 5/625–627; 15/257.1; 56/329
See application file for complete search history.

(56) References Cited

U.S. PATENT DOCUMENTS

| | | | | |
|---|---|---|---|---|
| 2,789,571 A * | 4/1957 | Kurwan | ..... | 135/34.2 |
| 4,296,788 A | 10/1981 | Slater | ..... | 150/52 R |
| 4,434,829 A * | 3/1984 | Barnard | ..... | 383/34 |
| 4,519,183 A | 5/1985 | Parody | ..... | 53/461 |
| 5,147,102 A | 9/1992 | Dyer, Jr. | ..... | 294/152 |

* cited by examiner

*Primary Examiner*—Dean J. Kramer
(74) *Attorney, Agent, or Firm*—Philip L. Bateman

(57) ABSTRACT

Lawn debris such as leaves and grass clippings are carried in a rectangular sheet of material. The sheet has a pocket along two of its opposite sides. Each pocket is sealed at each end. Inside each pocket is a rigid pole made of two sections fitting together end-to-end. Each pole has a length equal to about 80 to 100 percent of the length of the sheet.

7 Claims, 2 Drawing Sheets

LAWN DEBRIS CARRIER

CROSS-REFERENCE TO RELATED APPLICATION

This application claims the benefit of U.S. Provisional Application Ser. No. 60/605,641, Aug. 30, 2004.

FIELD OF THE INVENTION

This invention relates to material handling devices. More particularly, this invention relates to devices for carrying lawn debris.

BACKGROUND OF THE INVENTION

Moving lawn debris to a point of disposal has been a difficult and time-consuming task for many years. The term "lawn debris" is used herein to include all forms of relatively low density lawn debris, including leaves, grass clippings, twigs, and the like. In the past, lawn, lawn debris was commonly burned. In recent years, it has become more common for lawn debris to be loaded into degradable bags which are then taken to a landfill. A variety of tools and products are used for moving lawn debris, including rakes, blowers, and sheets of material. A sheet is used by first laying it upon the ground, then moving lawn debris upon it, lifting the edges of the sheet, and then dragging or carrying it to the point of disposal. Many types and sizes of sheets are used to carry lawn debris, including tarps, bedding sheets or blankets, and sheets of plastic. However, such sheets lack rigidity. Accordingly, they are difficult for one person to use and are nearly impossible to use for dumping lawn debris into bags.

Sheet-type lawn debris carriers that are specifically designed for carrying and dumping lawn debris have been disclosed. These sheet-type lawn debris carriers comprise a sheet of material with rigid members contained within pockets that run along two opposite sides. After the carrier is filled with lawn debris, the rigid members are drawn together to hold the leaves and to make it easier for a single person to carry. For example, Slater, U.S. Pat. No. 4,296,788, issued Oct. 27, 1981, discloses a carrier with rigid members that are held within open-ended loops or sleeves. Parody, U.S. Pat. No. 4,519,183, issued May 28, 1985, discloses a carrier with rigid members that are held within open-ended loops or channels. Dyer, Jr., U.S. Pat. No. 5,147,102, issued Sep. 15, 1992, which is incorporated by reference, discloses a trapezoidal leaf carrier that has wooden dowels within pockets that are heat-sealed or stitched at the ends to hold the dowels in place.

For a variety of reasons, none of the above lawn debris carriers has achieved commercial success. First of all, they take up a large amount of storage space when not in use. Secondly, some of the carriers have rigid members that fall out of the pockets at undesirable times. Thirdly, some of the carriers have rigid members that do not run the entire length of the sheet. As a result, the sheet tends to collapse and make loading difficult. Fourthly, a trapezoidal shape is undesirable because lawn debris does not readily flow in a funnel. Instead, it tends to compact and bridge. Accordingly, a demand exists for a sheet-type lawn debris carrier that takes up much less space when packaged and when not in use and that is easily used by a single person for both carrying and dumping lawn debris.

SUMMARY OF THE INVENTION

The general object of this invention is to provide an improved lawn debris carrier.

I have invented a carrier for lawn debris comprising a rectangular sheet of material having an inner side, an outer side, and a centrally-mounted handle on its outer side. The sheet has a pocket along two opposite sides. Each pocket has a length greater than the length of the side of the sheet adjacent the pocket. Each pocket is sealed at each end and has an opening located midway along its length. The carrier also comprises a rigid pole inside each pocket. Each pole is made of two sections fitting together end-to-end and has a length equal to about 80 to 100 percent of the length of the sheet.

The leaf carrier takes up little space when packaged and also takes up little storage space when not in use because the rigid poles can be removed and taken apart. The rigid poles extend substantially the entire length of the sheet and prevent the sheet from collapsing. The rectangular shape reduces compacting and bridging as the lawn debris is dumped.

DETAILED DESCRIPTION OF THE INVENTION

Figure 1:
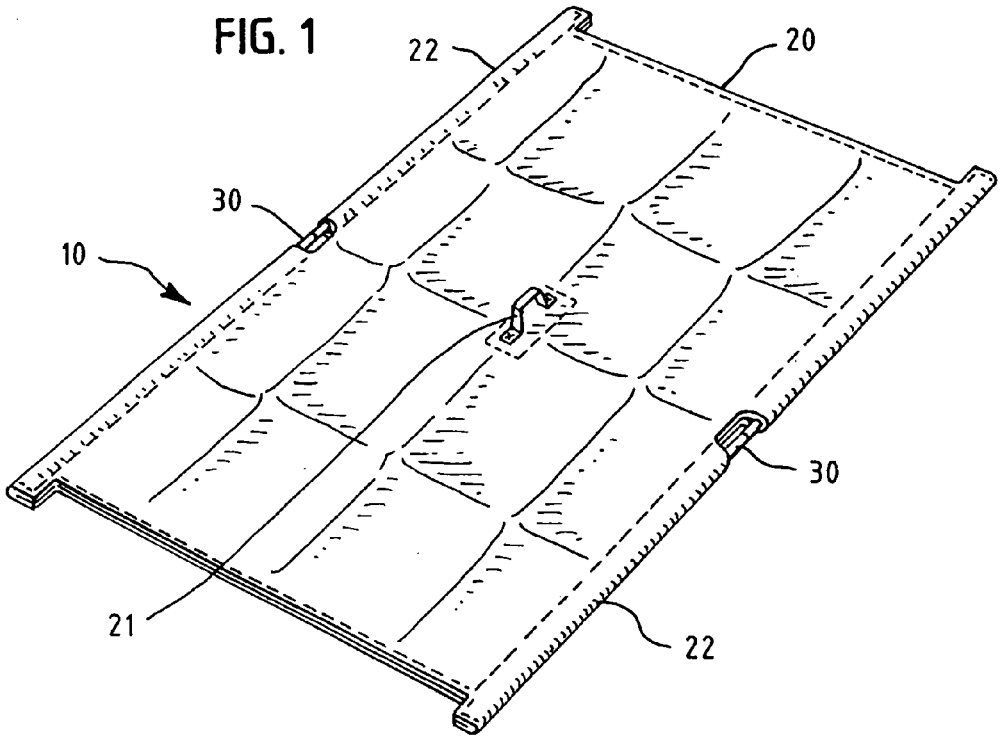
FIG. 1 is a perspective view of a preferred embodiment of the outer side of the lawn debris carrier of this invention.

This invention is best understood by reference to the drawings. Referring to FIG. 1, the preferred embodiment of the lawn debris carrier 10 of this invention comprises a sheet 20 and two rods 30. The two components are discussed in detail below.

The sheet is made of a durable light weight material. Various materials are suitable, including plastics, fabrics, and coated fabrics. The preferred material is a rubber-backed nylon tarp. The rubber-backed side is used for the inside—the side that carries the lawn debris. This material is durable, light in weight, easily washable (especially the rubber-backed side), waterproof, weatherproof, and relatively inexpensive. The color of the sheet is a matter of choice.

The sheet has an inner side for holding the leaves and an outer side. As mentioned above, the inner side is preferably rubber-coated for ease of washing. The outer side contains a handle 21. In the preferred embodiment, the handle is centrally located on the outer side and consists of a fabric strap sewn onto the sheet.

The sheet is rectangular in shape. The size of the sheet is a matter of choice. As the size increases, the amount of leaves that can be carried increases but the weight also increases. The sheet generally has a length of about four to ten feet and a width of about three to nine feet. In the preferred embodiment, the sheet has a length of about 86 inches and a width of about 63 inches. This size holds approximately 50 pounds of lawn debris and yet weighs only about 5 pounds when empty.

The sheet has two pockets 22. A pocket runs along each of two opposite sides. The pockets are formed by stitching, heat sealing, or the like. The pockets hold the rods in place and are large enough so the rods can rotate freely. An opening is located midway along each pocket to provide access to the rods. The pockets have a length slightly greater than the length of the sheet. In other words, the pockets extend beyond the sheet for about one to six inches, preferably about two inches, at each end. As explained below, the extensions enable the rods (which run the entire length of the sheet) to be fitted together and taken apart while in the pockets. Both ends of the pockets are sealed to hold the rods in place.

Figure 2A:
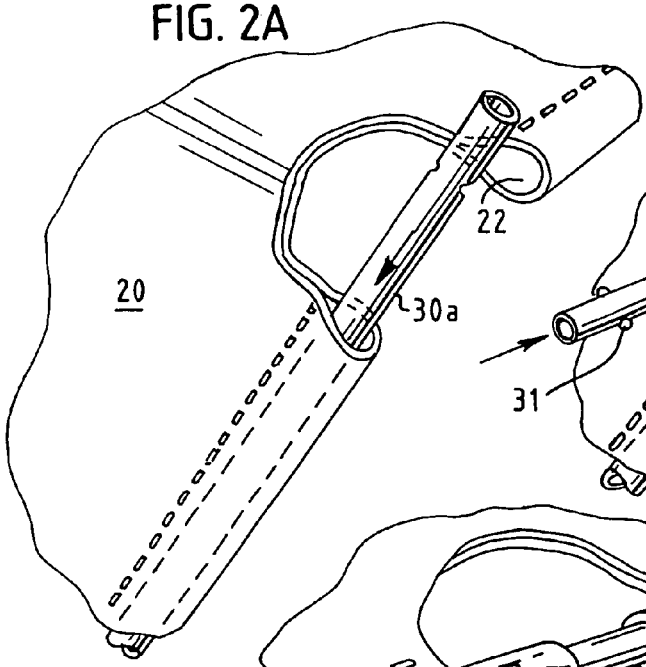
FIG. 2A is a detailed perspective view showing a first step in the assembly of the two sections of a pole.
Figure 2B:
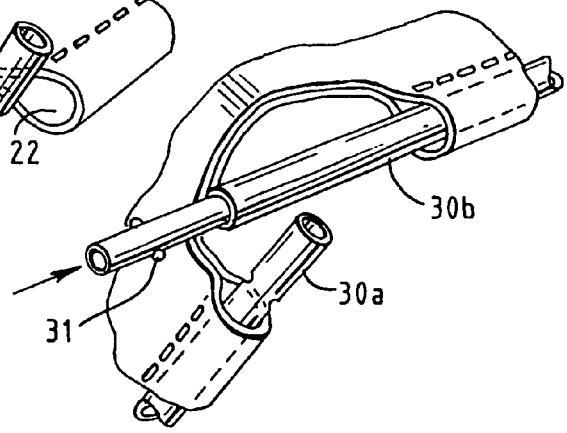
FIG. 2B is a detailed perspective view showing a second step in the assembly of the two sections of a pole.

Inside each pocket is a rigid rod made of two sections 30*a* and 30*b* that fit together end-to-end. The rods are made of a durable, relatively stiff material such as steel, aluminum, or plastic. In the preferred embodiment, the rods are made of plastic-coated steel tubing. The two sections of the rod are substantially the same length. One end of one section fits within one end of the other section. A frictional fit is suitable, but other mechanisms are added if a more secure fit is desired. In the preferred embodiment, the end of the section that fits within the other end contains two spring-loaded balls 31 as shown in FIG. 2B that provides a more secure fit.

When assembled, the rod has a length of about 80 to 100 percent, preferably about 90 to 95 percent, of the length of the sheet. In the preferred embodiment, the assembled rod has a length of 80 inches, or about 93 percent of the 86 inch length of the sheet. The diameter of the rod is generally about one-fourth to two inches, preferably about one-half to one inch, and most preferably about five-eighths inch.

Figure 2C:
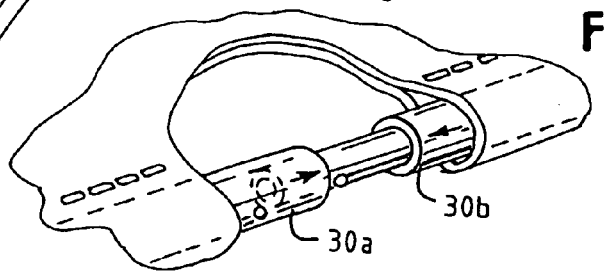
FIG. 2C is a detailed perspective view showing a third step in the assembly of the two sections of a pole.

To assemble the carrier, the sheet is laid out on a flat surface. The two sections of each rod are inserted through the openings as shown in FIGS. 2A and 2B and moved toward the ends. The two ends of the sections are then gripped in the opening and connected together as shown in FIG. 2C. The leaf carrier is disassembled by reversing this process. When disassembled, the sheet can be folded into a small size and the four rod sections can be secured together.

Figure 3:
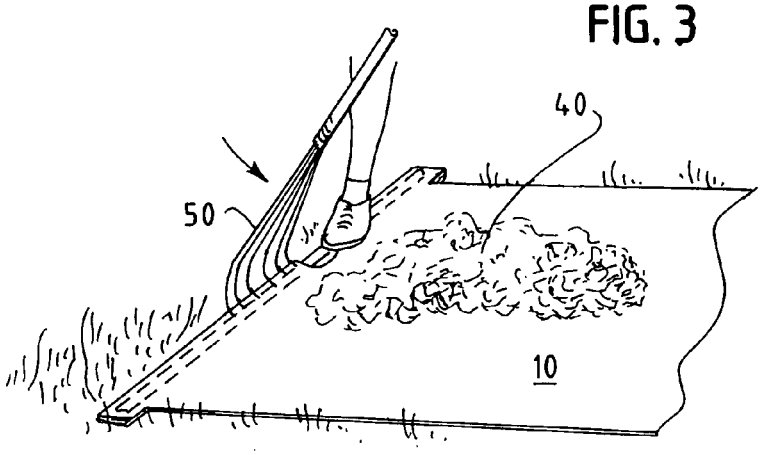
FIG. 3 is a perspective view showing a first step in the use of the lawn debris carrier.
Figure 4:
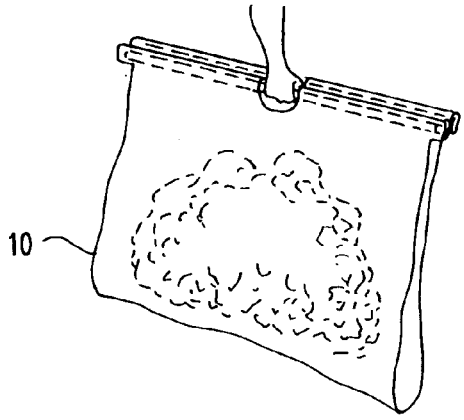
FIG. 4 is a perspective view showing a second step in the use of the lawn debris carrier.
Figure 5:
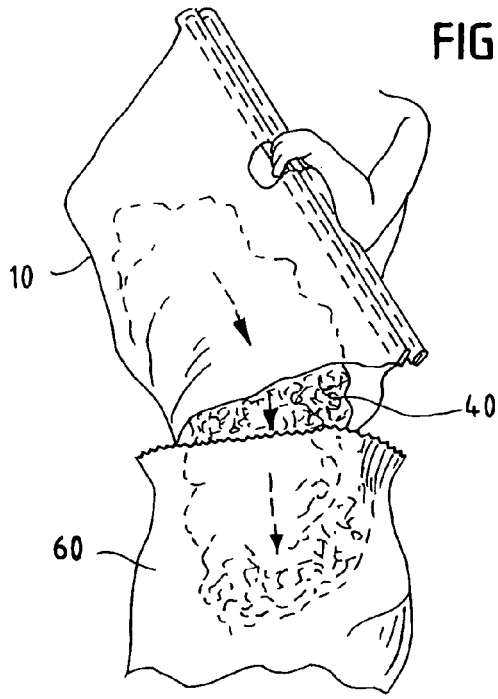
FIG. 5 is a perspective view showing a third step in the use of the lawn debris carrier.

The use of the carrier is illustrated in FIGS. 3 to 5. Referring to FIG. 3, the assembled lawn debris carrier is placed on the ground and one foot is placed on a rod to hold the carrier in place. Lawn debris 40 is then moved upon the carrier with a rake 50, a blower, or by other means. The rods are then lifted up and brought together as shown in FIG. 4. The lawn debris carrier can easily be carried by a single person. To dump the lawn debris into a bag 60 or can, the carrier is tilted as shown in FIG. 5. Shaking the carrier helps to speed the flow of the lawn debris into the bag or can.

I claim:

1. A carrier for lawn debris comprising a rectangular sheet of material having an inner side, an outer side, and a centrally-mounted handle on its outer side; the sheet having a pocket along two opposite sides, each pocket having a length greater than the length of the side of the sheet adjacent the pocket, each pocket being sealed at each end, each pocket having an opening located midway along its length; and a rigid pole inside each pocket, each pole being made of two sections fitting together end-to-end and having a length equal to about 80 to 100 percent of the length of the sheet.

2. The carrier of claim 1 wherein the material is rubber-backed nylon tarp.

3. The carrier of claim 2 wherein the sheet of material has a length of about four to ten feet and a width of about three to nine feet.

4. The carrier of claim 3 wherein the pockets extend beyond the sheet for about one to six inches at each end.

5. The carrier of claim 4 wherein the two sections of each pole are substantially the same length.

6. The carrier of claim 5 wherein each pole has a length of about 90 to 95 percent of the length of the sheet.

7. The carrier of claim 6 wherein the poles have a diameter of about one-fourth to two inches.

* * * * *